United States Patent [19]

Mizutani et al.

[11] Patent Number: 4,966,486

[45] Date of Patent: Oct. 30, 1990

[54] BINDER ASSEMBLY

[75] Inventors: Satoshi Mizutani; Hiroaki Nakada, both of Tokyo, Japan

[73] Assignee: King Jim Co., Inc., Tokyo, Japan

[21] Appl. No.: 388,865

[22] Filed: Aug. 3, 1989

[30] Foreign Application Priority Data

Aug. 9, 1988 [JP] Japan ..... 63-105051[U]

[51] Int. Cl.[5] ..... B42F 13/34

[52] U.S. Cl. ..... 402/68; 402/60; 402/72

[58] Field of Search ..... 402/68, 72, 60

[56] References Cited

U.S. PATENT DOCUMENTS 2,915,068 12/1959 Miyamoto ..... 402/60

4,113,394 9/1978 Giulie ..... 402/68

FOREIGN PATENT DOCUMENTS 2192588 1/1988 United Kingdom ..... 402/60

*Primary Examiner*—Paul A. Bell

*Assistant Examiner*—Hwei-Siu Payer

*Attorney, Agent, or Firm*—Wegner & Bretschneider

[57] ABSTRACT

A binder assembly comprising a binder cover and a binder body is detachably coupled to a file. The binder cover has a protrusion and the binder body has an end protrusion being formed at the outer sides of one end of the binder cover and body. The binder assembly can cover the upper and lower ends of a guide card mounted on a shelfback of the file to keep the guide card at the suitable position thereon.

5 Claims, 2 Drawing Sheets

BINDER ASSEMBLY

BACKGROUND OF THE INVENTION

1. FIELD OF THE INVENTION

This invention relates to a binder assembly for keeping documents on a file.

2. STATEMENT OF THE PRIOR ART

A conventional file has a transparent plastic sheet mounted on the outer face of a shelfback of a file. A guide card is disposed in the aperture between the shelfback and the plastic sheet. However, the guide card sometimes falls from the aperture, since there is no stop at the upper and lower ends of the aperture.

Further, when such a file is placed on a shelf or a desk, the guide card often protrudes from the upper or lower end of the shelfback to contact the shelf or the desk. Consequently, the upper and lower ends of the guide card are damaged and its appearence is affected.

SUMMARY OF THE INVENTION

An object of the present invention is to provide a binder assembly which keeps the guide card at a suitable position on the shelfback of the file.

A binder assimbly according to the present invention can overcome the drawback mentioned above by providing a binder assembly comprising a binder cover and a binder body each made of a relatively hard plastic a low elasticity with protrusions at the outer sides (i.e. a side opposite to the side on which documents are to be filed) of one end of the binder cover and body, respectively. The protrusions are provided so that they can cover the upper and lower ends of the guide card and can keep the card at the suitable position on the shelfback of the file.

BRIEF DESCRIPTION OF THE DRAWINGS

Other objects and features provided by the present invention will become apparent from the ensuing detailed description of the invention and the presently preferred embodiment with reference to the accompanying drawings, which are given for the purpose of illustration alone, and in which.

DETAILED DESCRIPTION OF THE PREFERRED EMBODIMENT

Figure 1:
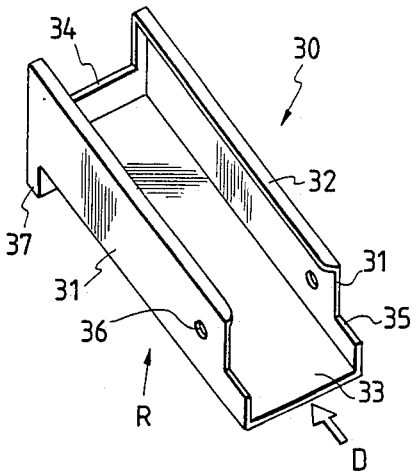
FIG. 1 is a perspective view showing a binder cover in accordance with the present invention.
Figure 2:
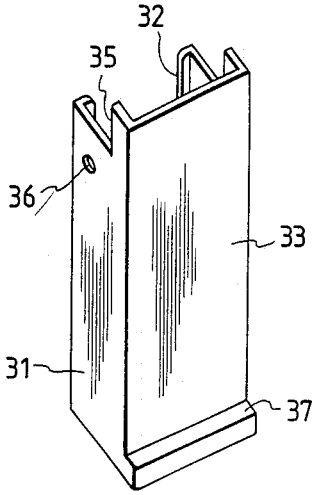
FIG. 2 is a perspective view taken along the arrow R in FIG. 1.

Referring now to the drawings, and embodiment according to the present invention will be apparent from the following explanation. FIG. 1 is a perspective view showing a binder cover 30. FIG. 2 is a perspective view taken along an arrow R in FIG. 1. The binder cover 30 made of a relatively hard plastic with a low elasticity has roght and left side plates 31, 31, over hang portions 32, 32 extending inwardly from the upper ends of the side plate, bottom plate 33, and end plate 34. The side plate 31 has a recess 35 at the open end of the binder cover 30. The reference number 36 denotes a hole for a binder body to be mentioned later. A Protrusion 37 is formed on the outer side of the end plate 34.

Figure 3:
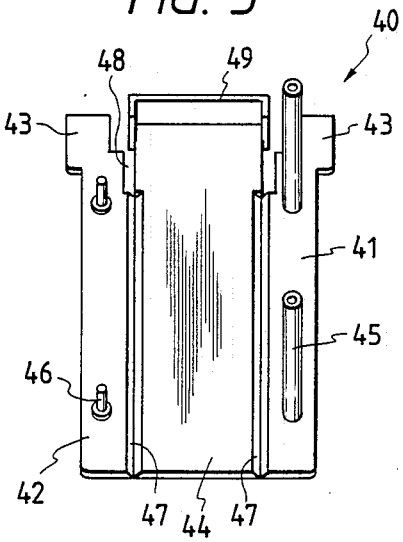
FIG. 3 is a perspective view showing a binder body in an open position.
Figure 4:
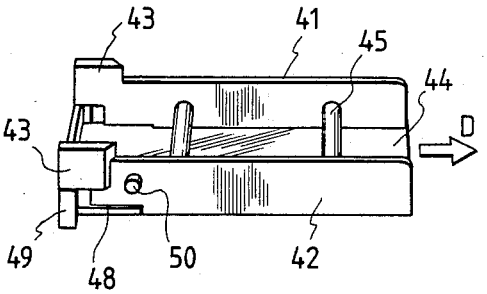
FIG. 4 is a perspective view showing the binder body in a closed position.

FIG. 3 illustrates a binder body 40 in an open position while FIG. 4 illustrates the body 40 in the closed position. The binder body 40 has a central bottom plate 44 and right and left turnable side plate 41, 42 pivotably connected through hinges 47 to the bottom plate 44.

The turnable side plate 41 is provided with a plurality of binding pipes 45, 45 (two pipes in the drawing) while the turnable side plate 42 is provided with a plurality of binding rods 46 at the positions corresponding to those of the binding pipes 45. Further, the turnable, side plates 41, 42 have a clamp 43 at one end thereof. The bottom plate 44 has an end protrusion 49 at the side of the clamp 43 projecting outwardly from the bottom plate 44. The side plates 41, 42 have a pin 50 at their outer surfaces, which engages with the hole 36 formed in the under cover 30.

When the binder body 40 is to be closed, the turnable side plates 41, 42 turn toward the center of the bottom plate 44 from both sides, the free ends of the binding rods 46 enter into the binding pipes 45 thereby both turnable side plates are engaged with each other. Thus, the binder body 40 is brought into the closed position as shown in FIG. 4.

When a user clamps the clamp 43 and inserts the binder body 40 into the binder cover 30 through the open end thereof in the direction shown by the arrow D in FIGS. 1 and 4, the binder body 40 is coupled to the binder cover 30 to form a binder assembly. Thus, the upper edges of the side plates 41, 42 engage with the lower side of the overhang portion 32 and the top end of the side plates 41, 42 contacts with the end plate 34. The clamp 43 is disposed in the recess 35 of the side plate 31 and the pin 50 of the binder body 40 is inserted into the hole 36 of the binder cover 30. Thus coupling is assured by the action of a recess 48 formed in the vicinity of clamp 43 between the bottom plate 44 of the binder body and the turnable side plates 41, 42 as shown by FIGS. 3 and 4, and by the inward deflection of the side plates 41, 42.

Figure 5:
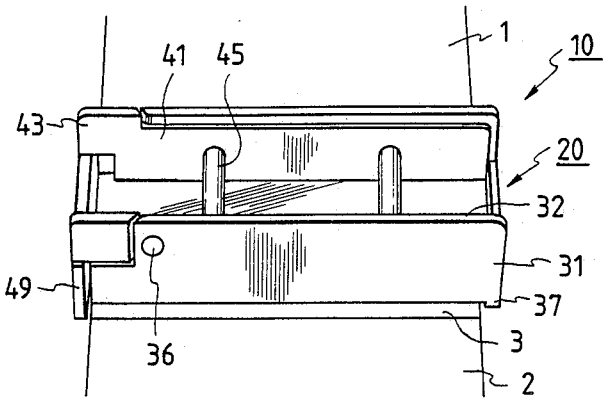
FIG. 5 is a perspective view showing a binder assembly attached to a file.
Figure 6:
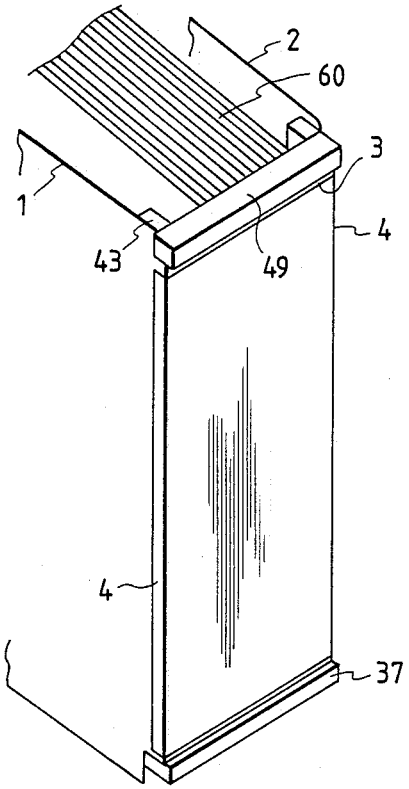
FIG. 6 is a perspective view showing a shelfback of a file.

FIG. 5 illustrates a binder assembly 20 attached to a shelfback 3 of a file 10. The binder assembly 20 is constructed in combination of the binder cover 30 and the binder body 40 as mentioned above. FIG. 6 illustrates the shelfback 3. The reference numbers 1 and 2 show the covers of the file 10. A transparent plastic sheet 4 is mounted on the shelfback 3 to define an aperture which receives a guide card. The aperture for the guide card is provided, as in an eave-like manner, with an end protrusion 49 of the binder body 40 and the protrusion 37 of the binder cover 30 at the opposite ends of the aperture so that the end protrusions 49, and the protrusion 37 covers the guide card at the upper and lower ends as shown in FIG. 6.

In use of the binder assembly 20, the binding pipes 45 receive a document 60, the turnable side plates 41, 42 are turned toward each other to cause the binding rods 46 to be inserted into the binding pipes 45, and the binder body 40 in the closed position is inserted into the binder cover 30.

When the clamps 43 are pressed toward each other by the fingers of the user in order to open the binder body 40, the turnable side plates 41, 42 are deflected inwardly as mentioned above so that the pins 50 are disengaged from the holes 36 and the binder body 40 is drawn from the binder cover 30.

When the binder assembly is in use in the close position, the protrusions of the binder cover and the binder body can cover the upper and lower ends of the guide card, so that the guide card cannot fall from the binder assembly.

When the binder assembly is placed on a shelf or a desk, the guide card does not stick out from the upper or lower end of the shelfback. Accordingly, the guide card will not be subjected to damage due to its direct contact with the shelf or the desk.

What is claimed is:

1. A binder assembly comprising a binder cover and a binder body each made of a relatively hard plastic with a low elasticity for detachable coupling to a shefback of a file, wherein:

(a) the binder cover comprises a bottom plate, right and left side plates extending from said bottom plate, and an end plate extending from said bottom plate and connecting said right and left side plates, wherein said side plates have a recess at an open end of the binder cover;

(b) the binder body comprises a central bottom plate, and right and left turnable side plates being pivotably connected through hinges to said central bottom plate, wherein said turnable side plates include binding pipes and binding rods such that said binding pipes and binding rods mutually cooperate when said binder body is in a closed position to form sheet retainers, and wherein said turnable side plates include clamps at one end thereof; and (c) said end plate of said binder cover has a protrusion projecting from an outer side of the binder cover, and said central bottom plate of said binder body has an end protrusion projecting from an outer side of the binder body in the vicinity of said clamps.

2. The binder assembly of claim 1, wherein each of said side plates of the binder cover contains a hole therein, and wherein each of said side plates of the binder body contains a pin extending outwardly therefrom, positioned such that each pin may engage with one of the holes.

3. The binder assembly of claim 1, wherein the binder cover further includes overhang portions, such that an overhang portion extends inwardly from an upper end of each of said side plates for engaging with upper edges of said turnable side plates of the binder body.

4. The binder assembly of claim 1, wherein the binder body further includes a recess formed between said central bottom plate and said right turnable side plate in the vicinity of said clamp, and a recess formed between said central bottom plate and said left turnable side plate in the vicinity of said clamp.

5. The binder assembly of claim 1, wherein said binding pipes are provided on one of said turnable side plates, and said binding rods are provided on the other said turnable side plate.

* * * * *